US006200525B1

(12) United States Patent
Bequette

(10) Patent No.: US 6,200,525 B1
(45) Date of Patent: Mar. 13, 2001

(54) HOLD-DOWN SYSTEM FOR COMPACTING PRESS

(75) Inventor: Todd A. Bequette, Geneva, IL (US)

(73) Assignee: Amsted Industries Incorporated, Chicago, IL (US)

( * ) Notice: Subject to any disclaimer, the term of this patent is extended or adjusted under 35 U.S.C. 154(b) by 0 days.

(21) Appl. No.: 09/366,516

(22) Filed: Aug. 3, 1999

(51) Int. Cl.[7] ..... B22F 3/00

(52) U.S. Cl. ..... 419/38; 425/78; 425/260; 425/448

(58) Field of Search ..... 425/78, 258, 260, 425/447, 448; 419/38

(56) References Cited

U.S. PATENT DOCUMENTS

| | | | | |
|---|---|---|---|---|
| 3,893,791 | * | 7/1975 | Plocher et al. | 425/78 |
| 4,813,818 | * | 3/1989 | Sanzone | 406/122 |
| 5,213,816 | | 5/1993 | Smyth, Jr. et al. | 425/78 |
| 5,593,707 | | 1/1997 | Goe et al. | 425/257 |
| 5,733,588 | * | 3/1998 | Chatterjee et al. | 425/260 |
| 5,858,415 | | 1/1999 | Bequette et al. | 425/78 |
| 5,945,135 | * | 8/1999 | Beane et al. | 425/260 |

OTHER PUBLICATIONS

Fig. 9 prior art press assembly, and description beginning at p. 1, line 23 of the present application.

Figs. 10–11 prior art press assembly, and description beginning at p. 1, line 23 of the present application.

* cited by examiner

*Primary Examiner*—Harold Pyon
*Assistant Examiner*—Donald Heckenberg
(74) *Attorney, Agent, or Firm*—Edward J. Brosius; Stephen J. Manich

(57) ABSTRACT

A press for compacting raw material into compacted elements is disclosed. The press has a vertically movable platen and a feed shoe on the platen. The feed shoe is urged against the platen by a pair of force-transmitting devices and lever arms. The lever arms are also connected to a frame. The frame is vertically fixed, and the lever arms pivot on the frame as the feed shoe and platen move vertically. The feed shoe is movable horizontally on the platen between a feed position overlying a bore and die in the platen and a press position horizontally spaced from the bore and die. The frame, force-transmitting devices and lever arms all move horizontally with the feed shoe. The assembly is moved horizontally by a linear drive mechanism. A pair of supplemental support rods are connected to the frame to relieve stress on the linear drive mechanism and to stabilize the frame. The force-transmitting devices are predominantly vertical, and are positioned so that at least part of each of the force-transmitting devices is between the planes of the front and back of the feed shoe. Quick release devices are used to connect the feed shoe to the lever arms to allow for quick and simple changeover of feed shoes. The press of the present invention reduces the number of parts that bear against each other to improve the longevity of the press. The design of the press is efficient in that the force-transmitting devices need not be over-engineered, since the force is essentially applied vertically.

27 Claims, 6 Drawing Sheets

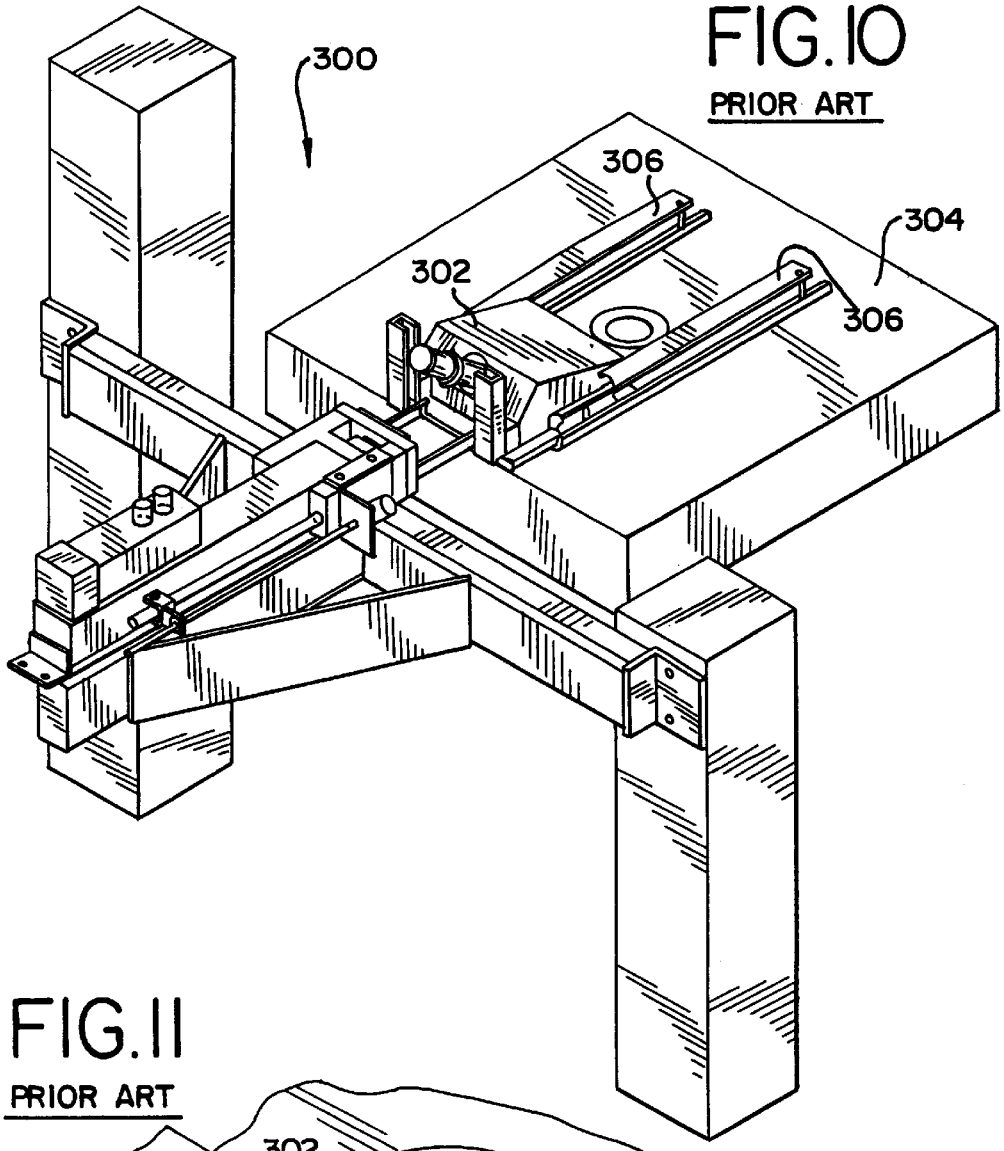
FIG. 10
PRIOR ART
FIG. 11
PRIOR ART
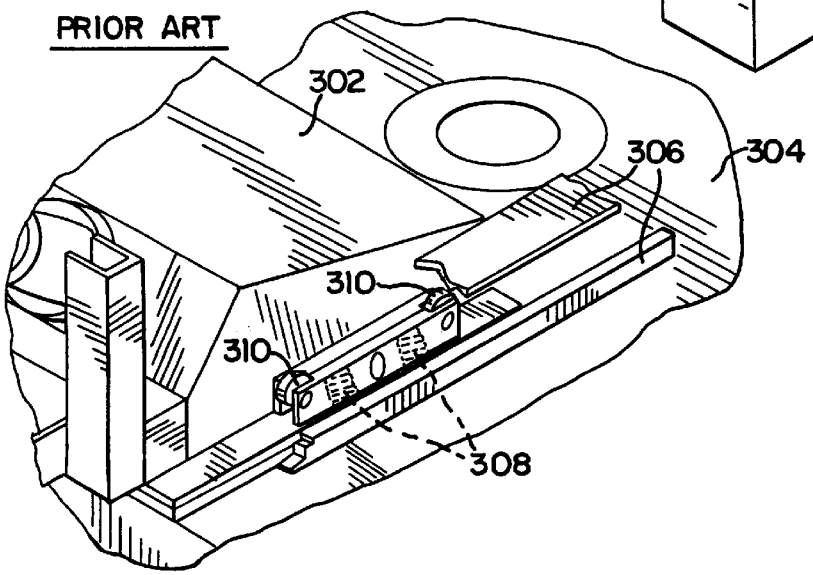

HOLD-DOWN SYSTEM FOR COMPACTING PRESS

BACKGROUND OF THE INVENTION

1. Field of the Invention

The present invention relates to a compacting press that includes a system for holding a feed shoe down against a platen, and more particularly, to such a press for making powder metal compacts.

2. Description of the Prior Art

It is known to produce metal parts by compacting metal powder and heating the compacted metal powder to sinter the metal particles to produce a finished metal product. In one type of commercially available compacting press, metal powder is typically delivered to a feed shoe, or shuttle assembly. The feed shoe is movable on the press table between a retracted position and an extended position. In the extended position, metal powder in the feed shoe drops into a die cavity. The feed shoe is then retracted and then upper and lower punches compact the metal powder in the die cavity to form a green compact. A core rod is also extended to form any inner diameter of the powder metal part. The compact is then ejected from the die cavity. When the compact is ejected, the press table lowers and then is raised back to the original level after the compact is removed. More raw metal powder is delivered to the feed shoe, and the feed shoe is extended over the die to feed another quantity of metal powder to the die. The cycle continues as additional green compacts are made.

In such presses, it is necessary to hold the feed shoe against the top surface of the press table or platen to ensure that the metal powder is properly distributed to the die. If the feed shoe were to raise up, an inadequate quantity of metal powder may be fed to the die, and the green metal compact produced could fall below quality criteria.

Two different types of prior art compacting presses are illustrated in FIGS. 9–11. In the type of press 200 illustrated in FIG. 9, the feed shoe 202 is smaller than the feed shoe 302 in the type of press 300 illustrated in FIGS. 10–11. In the FIG. 9 type of press, the feed shoe 202 is typically about 4 inches wide, while the feed shoe 302 of the FIGS. 10–11 type of press may more typically be about 11 inches wide.

In the FIG. 9 type of press, the feed shoe 202 is moved toward and away from a die in the platen 204 and an overlying punch 206 during each cycle of operation. The feed shoe 202 is moved by a pivoting drive mechanism shown in FIG. 9. As the element shown at 208 is pivoted, the feed shoe 202 is pushed or pulled across the platen 204. The feed shoe 202 is held against the platen by a single air cylinder 210 acting against a bridge 212 between two lever arms 214. The air cylinder 210 is behind the feed shoe 202, and behind the feed tube 216 leading to the feed shoe 202. The air cylinder 210 is set at an angle of about 45° from vertical. The FIG. 9 type of press has somewhat limited utility, given the relatively small size of the feed shoe.

In the prior compacting press 300 illustrated in FIGS. 10–11, the feed shoe 302 is moved across the platen 304 by a linear drive. A system of rails and bearings has been used to hold the feed shoe 302 down against the surface of the press table or platen 304. The rails 306 are fixed to the platen 304. Springs 308 push roller bearings 310 up to bear against the rails 306, and the springs 308 push the feed shoe 302 down against the press platen 304, while allowing the feed shoe 302 to be extended and retracted. The rails 306 are long enough so that the feed shoe 302 is pushed against the press platen 304 throughout the range of horizontal motion of the feed shoe 302.

The use of the rails 306, springs 308 and bearings 310 has been problematic. The friction of the bearings 310 against the rails 306 may cause these elements to wear out relatively quickly. Uneven wear can cause part of the feed shoe 302 to raise away from the surface of the press table 304, resulting in uneven powder distribution and poor part quality. Replacement of worn elements has been time consuming, requiring removal of bolts holding the rails 306 to the press table 304.

SUMMARY OF THE INVENTION

The present invention is directed to providing a press with a hold-down assembly that holds the feed shoe against the press platen in an efficient manner using less expensive components, and that is versatile, allowing use of relatively large feed shoes.

In one aspect, the present invention provides a press for compacting raw material into a compact during a cycle of operation. The press comprises a vertically movable platen having a surface with a bore. A die is below the platen surface and aligned with the bore in the platen surface. A feed shoe is on the platen and is movable with vertical movement of the platen. The feed shoe is also movable horizontally across the platen surface from a press position spaced from the bore to a feed position overlying the bore to deliver raw material to the die. The press includes a movable punch to compact raw material in the die, a horizontally movable frame, a lever arm, and a force-transmitting device. The lever arm is connected to the frame and the feed shoe. The force-transmitting device is connected to act against the frame and the lever arm. The press includes a linear drive mechanism and a supplemental support connected, sized and positioned to relieve stress on the linear drive mechanism from operation of the force-transmitting device. The linear drive mechanism is connected to move the frame horizontally over at least part of the platen toward and away from the bore in the platen surface. The feed shoe, lever arm, force-transmitting device and at least part of the supplemental support move horizontally with the frame during each cycle of operation. The force-transmitting device urges the feed shoe against the platen during at least part of the horizontal movement of the feed shoe, force-transmitting device, lever arm and frame. The frame, linear drive mechanism and supplemental support are vertically fixed during each cycle of operation of the press. The feed shoe and platen move vertically during each cycle of operation of the press.

In another aspect, the present invention provides a press for compacting raw material into a compact during a cycle of operation. The press comprises a vertically movable platen having a surface with a bore. A die is below the platen surface and aligned with the bore in the platen surface. A feed shoe is on the platen and is movable with vertical movement of the platen. The feed shoe is also movable horizontally across the platen surface from a press position spaced from the bore to a feed position overlying the bore to deliver raw material to the die. The feed shoe has a front and a back. The press includes a movable punch to compact raw material in the die, a horizontally movable frame, a lever arm, and a force-transmitting device. The lever arm is connected to the frame and to the feed shoe. The force-transmitting device is connected to act against the frame and lever arm. A linear drive mechanism is connected to move the frame horizontally over at least part of the platen toward and away from the bore in the platen surface during each cycle of operation. The feed shoe, lever arm and force-transmitting device move horizontally with the frame during each cycle of operation. The force-transmitting device urges the feed shoe against the platen during at least part of the horizontal movement of the frame, feed shoe, lever arm and force-transmitting device. The frame and the linear drive mechanism are vertically fixed during each cycle of operation of the press, and the feed shoe and platen move vertically during each cycle of operation. At least part of the force-transmitting device lies between a vertical plane at the back of the feed shoe and a vertical plane at the front of the feed shoe during at least part of each cycle of operation.

In another aspect, the present invention provides a press for compacting raw material into a compact during a cycle of operation. The press comprises a vertically movable platen having a surface with a bore. A die is below the platen surface and aligned with the bore in the platen surface. A feed shoe is on the platen surface and is movable with vertical movement of the platen. The feed shoe is movable horizontally across the platen surface from a press position spaced from the bore to a feed position overlying the bore to deliver raw material to the die. The press also has a movable punch to compact raw material in the die, a horizontally movable frame, a lever arm, and a force transmitting device. The lever arm is connected to the frame and feed shoe. The force-transmitting device is connected to act against the frame and the lever arm. A linear drive mechanism is connected to move the frame horizontally over at least part of the platen toward and away from the bore in the platen surface during each cycle of operation. The lever arm, feed shoe and force-transmitting device move horizontally with the frame during each cycle of operation. The force-transmitting device urges the feed shoe against the platen during at least part of the horizontal movement of the frame, feed shoe, lever arm and force-transmitting device. The frame and linear drive mechanism are vertically fixed during each cycle of operation of the press. The feed shoe and platen move vertically during each cycle of operation. The force-transmitting device is aligned to be predominantly vertical during at least part of each cycle of operation.

In another aspect, the present invention provides a press for compacting raw material into a compact during a cycle of operation. The press comprises a vertically movable platen having a surface with a bore. A die is below the platen surface and aligned with the bore in the platen surface. The press also has a feed shoe on the platen. The feed shoe is movable with vertical movement of the platen, and is movable horizontally across the platen surface from a press position spaced from the bore to a feed position overlying the bore to deliver raw material to the die. The press has a movable punch to compact raw material in the die, a horizontally movable frame, a linear drive mechanism and a lever arm. The linear drive mechanism is connected to move the frame horizontally over at least part of the platen toward and away from the bore in the platen surface. The lever arm is connected to the frame and the feed shoe. A force-transmitting device is connected to act against the frame and the lever arm. A supplemental support is connected, sized and positioned to stabilize the frame. The frame, lever arm, feed shoe and force-transmitting device are movable horizontally during each cycle of operation. The force-transmitting device urges the feed shoe against the platen during at least part of the horizontal movement of the frame, lever arm, feed shoe and force-transmitting device. The frame, linear drive mechanism and supplemental support are vertically fixed during each cycle of operation of the press. The feed shoe and platen move vertically during each cycle of operation of the press.

BRIEF DESCRIPTION OF THE DRAWINGS

In the drawings, like numbers have been used for like parts and:

FIG. 10 is a perspective view of another prior art press assemble; and

FIG. 11 is an enlarged view of a portion of the prior art press assembly of FIG. 10.

DETAILED DESCRIPTION

Figure 1:
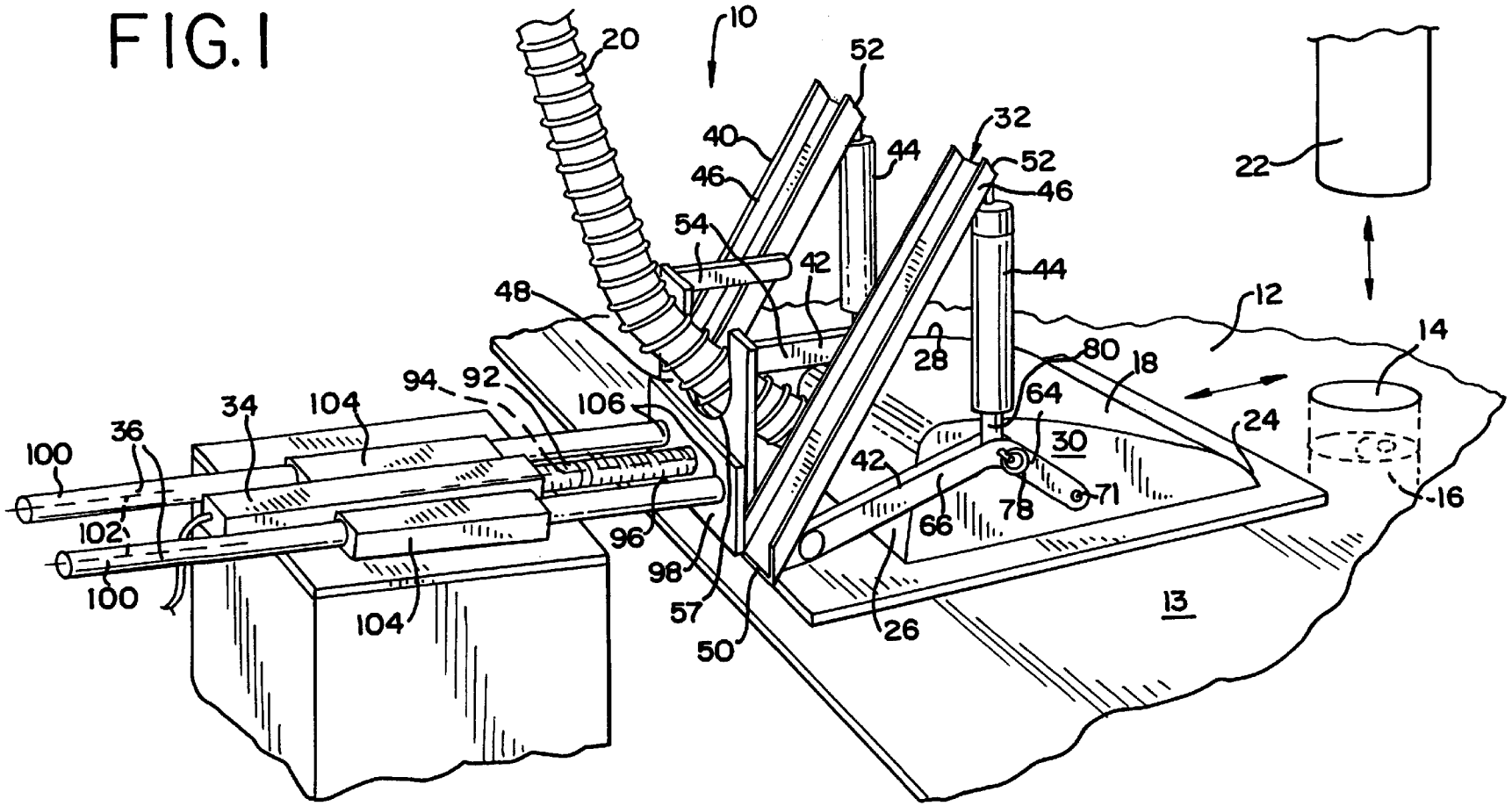
FIG. 1 is a perspective view of part of a press incorporating the principles of the present invention.

According to the present invention, there is provided a press 10 for compacting raw material into a compact during a cycle of operation. As shown in FIG. 1, the press 10 is an assembly of components that includes a vertically movable platen 12. The platen 12 has an upper surface 13 with a bore 14. A die 16 is below the surface 13 of the platen 12 and aligned with the bore 14 in the platen surface 13. The press 10 also includes a feed shoe 18, a raw material supply path 20 and a vertically-movable punch 22. The vertically-movable punch 22 is vertically aligned with the bore 14 and the die 16 and is movable to compact the raw material in the die.

Figure 7:
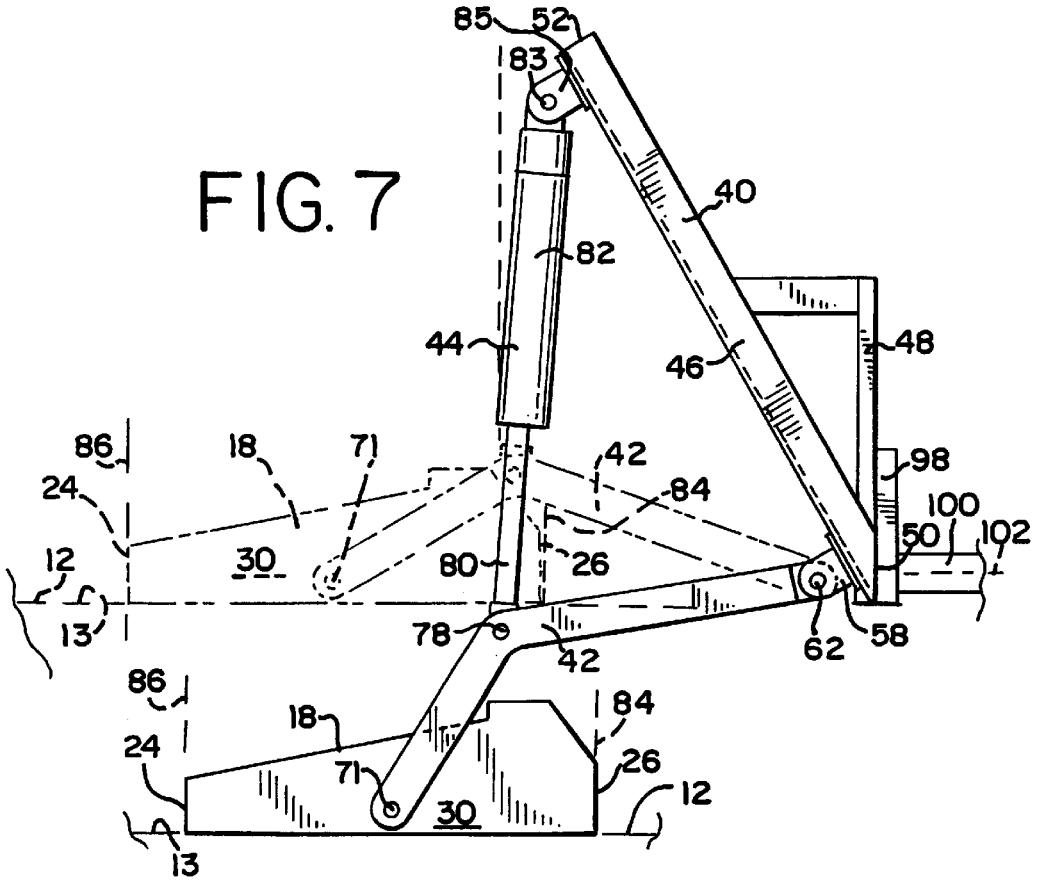
FIG. 7 is a side elevation of the hold-down system of FIG. 2, shown connected to a feed shoe and to a supplemental support, showing vertical movement of the feed shoe with the press platen while the frame of the hold-down system and supplemental support remain vertically-fixed.
Figure 8:
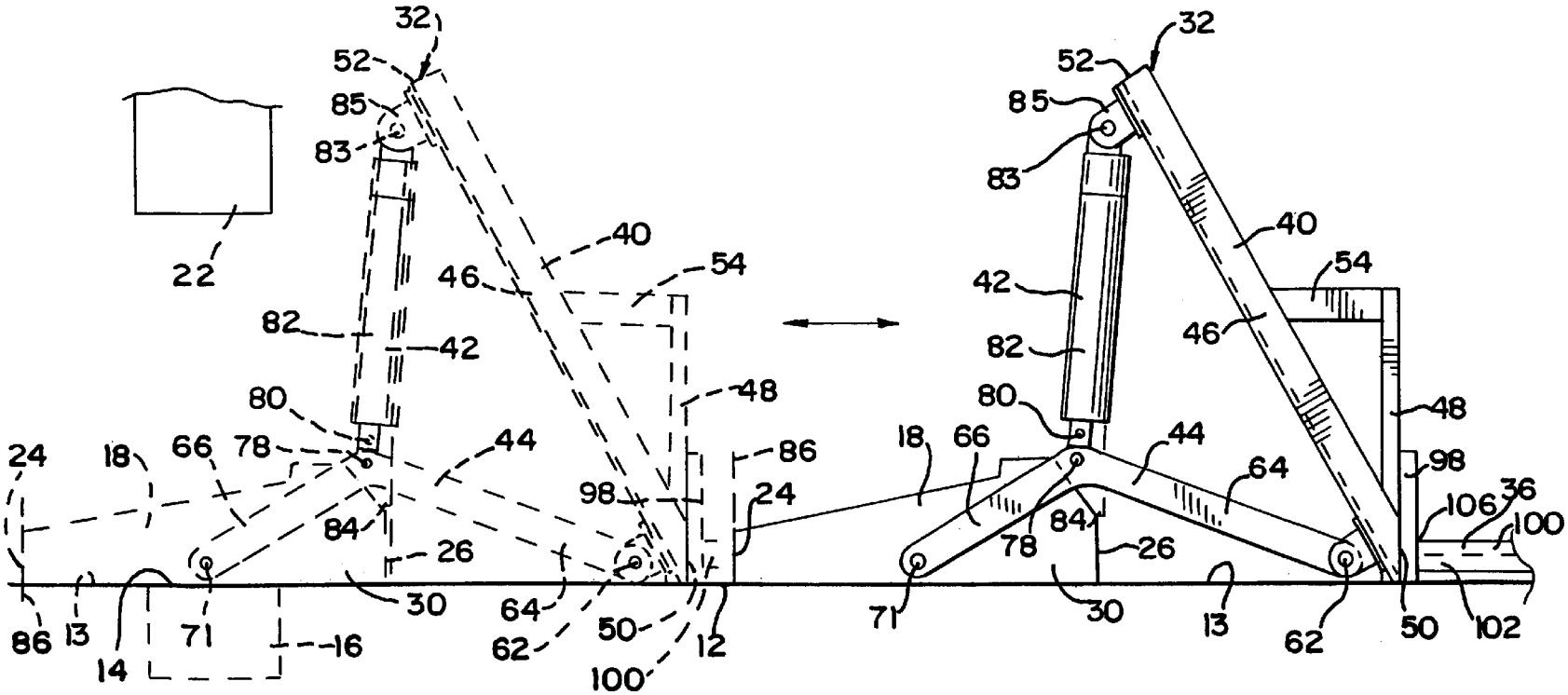
FIG. 8 is a side elevation of the force transmitting system of FIG. 2, shown connected to a feed shoe and to a supplemental support, showing horizontal movement of the feed shoe and hold-down system across the surface of the press platen.

The feed shoe 18 is supported on the platen 12 and is vertically-movable with vertical movement of the platen. Vertical movement of the feed shoe and platen is illustrated in FIG. 7. The feed shoe 18 is also horizontally movable across the surface 13 of the press platen 12 from a press position shown in FIG. 1 to a feed position. In the press position, the feed shoe 18 is horizontally spaced from the bore 14 in the surface 13 of the platen 12 so that the punch 22 may be lowered to the bore without interference from the feed shoe 18. In the feed position, the feed shoe 18 is positioned overlying the bore 14 to deliver raw material to the cavity of the die 16. Horizontal movement of the feed shoe 18 across the surface 13 of the platen 12 between the feed position and press position is illustrated in FIG. 8, the feed position being shown in phantom on the left and the press position being shown in solid lines on the right.

As shown in FIG. 1, the illustrated feed shoe has a front 24, a back 26 and two parallel sides 28, 30. The raw material supply path 20 is connected to deliver raw material to the feed shoe for delivery to the die 16. In the illustrated embodiment, the platen 12, die 16, feed shoe 18, punch 22 and raw material supply path 20 may be standard commercially available equipment typically used in such presses.

The present invention provides a unique hold-down system 32 for holding the feed shoe 18 against the platen 12, and a unique linear drive mechanism 34 and supplemental support 36 for moving the feed shoe 18 between its press and feed positions, while allowing the feed shoe 18 to move vertically with the platen 12.

As shown in FIG. 1, the hold-down system 32 of the present invention includes a horizontally movable frame 40, a pair of spaced generally parallel lever arms 42 and a pair of force-transmitting devices 44. The force-transmitting devices 44 are connected to act against the frame 40 and the lever arms 42.

Figure 2:
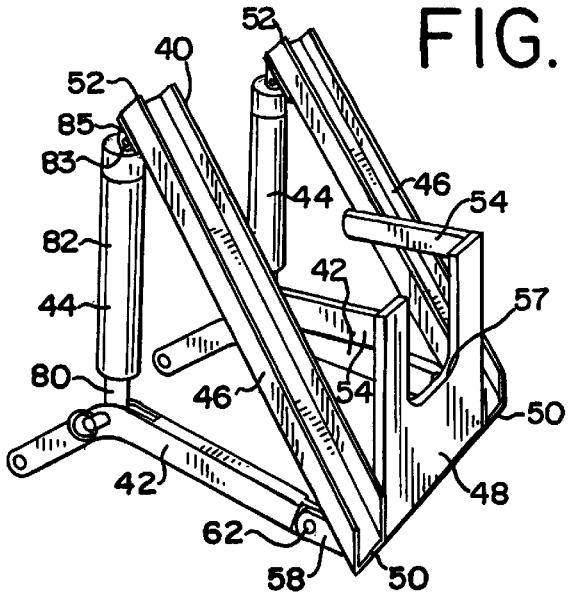
FIG. 2 is a perspective view of the hold-down system of the press assembly of FIG. 1, shown disconnected from the feed shoe of the press.
Figure 3:
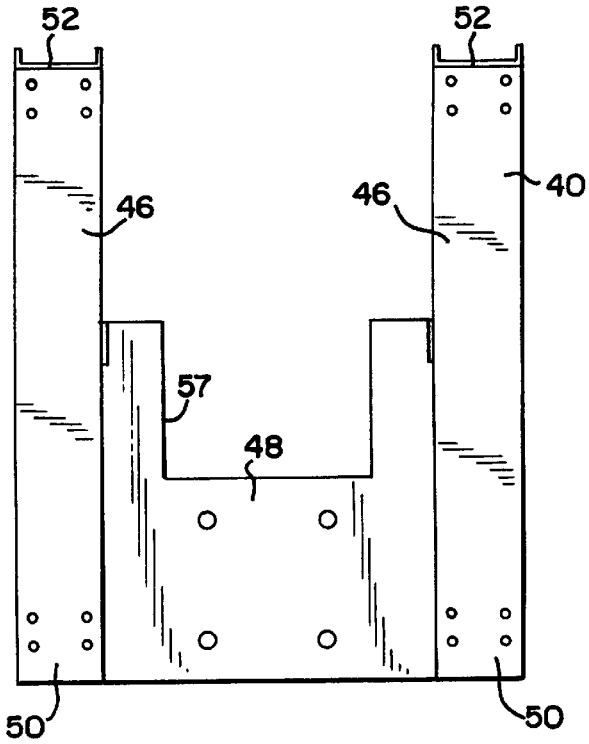
FIG. 3 is an end view of the frame of the hold-down system of FIG. 2.
Figure 4:
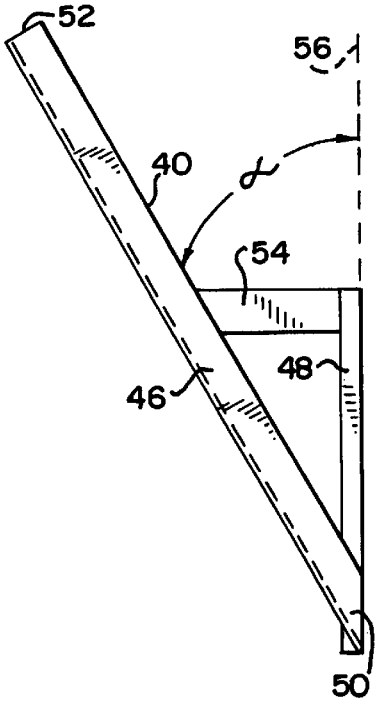
FIG. 4 is side elevation of the frame of FIG. 3.

As shown in FIGS. 1–4, the frame 40 includes a pair of spaced parallel frame arms 46 and a vertical member 48 positioned between the frame arms 46. Each frame arm 46 has a low point 50 and a high point 52. At the low points 50, the frame arms are connected to part of a vertical edge of the vertical member 48. Horizontal connectors 54 extend from the edges of the vertical member 48 near the top of the vertical member to a position about midway between the high points 52 and low points 50 of the frame arms 46. As shown in FIG. 4, each of the frame arms 46 is angled with respect to a vertical reference 56, defining an angle $\alpha$ of about 30° with the vertical reference 56; thus, the high points 52 of the frame arms 46 are horizontally spaced from the low points 50. As shown in FIGS. 7–8, when the frame 40 is assembled with the other components of the press assembly 10, the high point 52 of each frame arm 46 is between its low point 50 and the front 24 of the feed shoe 18.

As shown in FIGS. 1–3, the vertical member 48 of the frame 40 includes a cutout 57 along its top. The cutout 57 may comprise a combination of straight and curved edges, as shown in FIG. 2, or may comprise three straight edges meeting at square comers as shown in FIG. 3, or could comprise a continuous curve. As shown in FIG. 1, the cutout 57 is provided so that the raw material supply path 20 may be connected to the feed shoe 18 without interference from the vertical member 48.

In the illustrated embodiment, the raw material supply path 20 comprises a standard flexible tube connected to the back 26 of the feed shoe 18. The raw material supply path may comprise plastic polyvinylchloride wire-reinforced tubing, for example, although it should be understood that other materials may be used, such as polyurethane, polypropylene, nylon, cloth or fiber. Other forms of raw material supply paths may be used as well, such rigid tubes. Generally, the material and form of raw material supply path may be selected based upon standard considerations, such as the coefficient of friction, the smoothness of the inner diameter, the strength, durability, and cost, for example.

In the illustrated frame 40, each frame arm 46 is made of C-channel steel, and the vertical plate comprises ½ inch thick steel plate. In the illustrated embodiment, each frame arm 46 is has an overall length of $16\frac{15}{32}$ inches and a width of 2 inches. The vertical plate 48 has a width of $7\frac{25}{32}$ inches and a height at the horizontal connectors 54 of 8½ inches. The horizontal connectors 54 have widths of 1 inch and thicknesses of ⅛ inch. The elements of the frame are welded together.

It should also be understood that the particular frame illustrated and described above is provided by way of example only. Other structures and materials may be used for the frame, and the claims should not be considered to be limited to a particular frame structure, components, dimension, angle or material unless expressly set forth therein.

Figure 5:
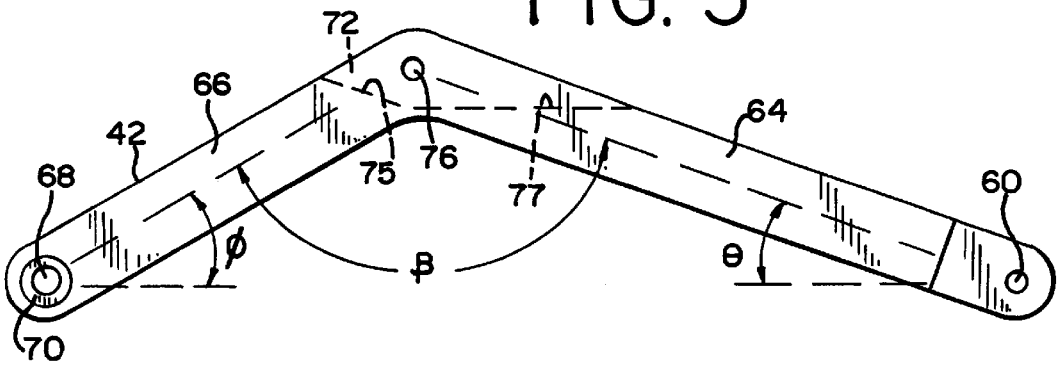
FIG. 5 is a side elevation of one of the lever arms of the hold-down system of FIG. 2.
Figure 6:
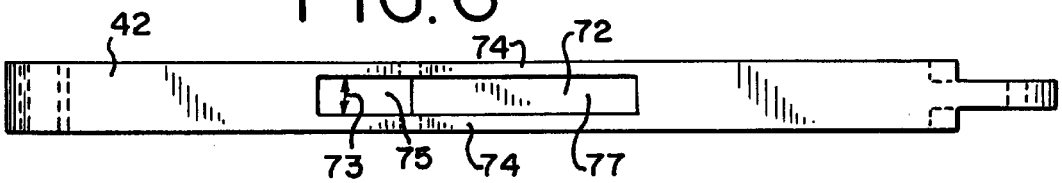
FIG. 6 is a top plan view of the lever arm of FIG. 5.

As shown in FIG. 2, near the low point 50 of each frame arm 46, the lever arms 42 of the hold-down system or assembly 32 are pivotally connected to a mounting clevis 58 fixed to the frame arm 46. As shown in FIGS. 5–6, the ends of the lever arms 42 may have reduced thicknesses to fit between the arms of the clevis 58, and may have holes 60 to receive a conventional pin 62 for pivotal mounting. The pin 62 may comprise a conventional clevis pin, such as a commercially-available stainless steel clevis pin. Each mounting clevis 58 may be fixed to the frame arm 46 by welding, nuts and bolts, or other conventional means.

As shown in FIG. 5, each lever arm 42 has two intersecting segments 64, 66, with the hole 60 at the end of one segment 64 and a hole 68 at about the opposite end of the other segment 66. The hole 68 may receive a conventional bushing or bearing 70. The bearings may comprise standard press-fit bearings, such as a sintered bronze bushing. As shown in FIG. 1, the hole 68 with the bushing or bearing 70 is connected to the feed shoe 18. Preferably, the connections between the feed shoe 18 and the lever arms 42 are through releasable connectors 71 such as quick-release pins, to allow for fast and simple changeover of feed shoes. In the illustrated embodiment, the pivotal connections between the lever arms and the feed shoe are horizontally aligned generally with the centroid of the feed shoe.

As shown in FIGS. 5–6, at about the intersection of the two segments 64, 66, each lever arm 42 has a cut out 72 defining two spaced parallel walls 74, each wall 74 having an aligned through-bore 76. As shown in FIGS. 2 and 7, each lever arm 42 is connected to one end of one force-transmitting device 44 at the through-bores 76 at about the intersection of the two segments 64,66 through a removable pin 78. The pins 78 may comprise hitch pin clips, such as stainless steel hitch pin clips available from Western Wire Products of St. Louis, Mo.

In the illustrated embodiment, each lever arm 42 is made of cold roll steel. Each lever arm 42 has an overall length, horizontally between the centerlines of the holes 60, 68, of $12\frac{19}{32}$ inches. The shorter segment 66 defines an angle of 30° with a horizontal reference, and the longer segment 64 defines an angle of 19.25° with the horizontal reference; these two angles are shown at $\Phi$ and $\theta$, respectively, in FIG. 5. The illustrated lever arms 42 each have a thickness of 0.900/0.920 inches at their widest, and a thickness of ⅜ inch at the end of the longer segment 64 at the hole 60. The cut out 72 of each lever arm 42 has a width of 0.500/0.520 inches, as shown at 73 in FIG. 6. Each cut out 72 is shaped so that there is a short bottom wall 75 and a longer bottom wall 77. The short bottom wall 73 is in a plane spaced about ½ inch from the centerline of the longer segment 64 of the lever arm. The longer bottom wall 77 is in a horizontal plane spaced about ½ inch from a horizontal plane through the hole 76.

It should be understood that the particular shape, dimensions, angles and materials of the lever arms 42 described and illustrated are provided by way of example only. Other shapes, dimensions, angles and materials may be used. The claims should not be considered to be limited to any particular shape, components, dimensions, angles or materials of lever arms unless expressly set forth therein.

The force-transmitting devices 44 may comprise air cylinders as in the illustrated embodiment. As there shown, the free end of each air cylinder's piston rod 80 is received in the cut out 72 of one lever arm 42; the piston rod 80 has a bore through which the pin 78 extends to connect one part of each force-transmitting device to each lever arm. The connection allows for pivoting between each lever arm 42 and each force-transmitting device 44.

The cylinder part 82 of each force-transmitting device is pivotally connected to the frame 40 through a pin 83 received in a clevis 85 fixed to the frame arm 46 substantially at the high point 52, as shown in FIG. 2. One air cylinder 44 is connected to one frame arm 46 and the other cylinder 44 is connected to the other frame arm. Commercially-available pins and devises may be used for these connections. Each clevis 85 may be fixed to the frame arm 46 by welding, nuts and bolts, or other conventional means.

The pressure provided by the air cylinders 44 may be about 40 psi, for example. An example of a suitable air cylinder 44 is one available from Bimba Manufacturing Company of Monee, Ill., Model 094-P. This air cylinder has a four inch stroke, operates at from 0 to 80 psi, has a 9/8 inch bore inner diameter and a pivot end. It should be understood that this air cylinder is identified for purposes of illustration only, and that other air cylinders can be used. Generally, the stroke length should accommodate the full range of up and down motion of the lever arms. It should also be understood that the force-transmitting devices 44 are not limited to air cylinders; other devices such as hydraulic cylinders and springs can be used, for example.

It should also be understood that although provision of two force-transmitting devices 44 is preferred, it may be possible to use a single force-transmitting device connected to the frame 40 and connected to transmit force to at least one of the lever arms 42. For example, a bridge could be provided between the lever arms 42, and a single force-transmitting member could be connected to transmit force to the bridge to thereby transmit force to the lever arms and feed shoe.

The hold-down system 32 of the present invention accommodates vertical movement of the feed shoe 18 with the platen 12. In a typical press assembly, the vertical motion between the positions shown in phantom and solid if FIG. 7 may be about 6 inches. As shown in FIG. 7, the frame 40 remains vertically fixed while the feed shoe 18 moves vertically. As the feed shoe 18 and platen 12 move vertically downward, the piston rods 80 of both air cylinders 44 telescope out of the cylinders 82, and the lever arms 42 pivot about their connections to the frame 40 and to the feed shoe 18. Throughout the range of vertical motion, the air cylinders or force-transmitting devices 44 may continue to apply pressure to the lever arms 42 at their leverage points at the intersection of the two segments 64, 66 through the pins 78. The pins 78 should accordingly be made of a material and be sized so that they can withstand the pressure applied by the air cylinders over repeated use.

As can be seen from FIG. 7, throughout the range of vertical motion of the feed shoe 18, the angle of the two segments 64, 66 of each lever arm 42 provides clearance so that the lever arms 42 do not interfere with movement of the feed shoe 18. In the illustrated embodiment, as shown in FIG. 5, the two segments 64, 66 of the lever arms 42 define an angle β of about 130° with each other, and the intersections of the two segments are both above the feed shoe 18 throughout the range of motion of the feed shoe. It should also be noted that the shape of the cutout 72 in each lever arm 42 also allows for pivoting between the lever arm 42 and piston rod 80 without interference. In the illustrated embodiment, the cutouts 72 are shaped so that even if the front segment 64 were vertical, the piston rod 80 may pivot without interference.

As can also be seen from FIG. 7, throughout the range of vertical motion of the feed shoe 18, the force transmitting members or air-cylinders maintain a constant angle with respect to a vertical reference. In the illustrated embodiment, the air cylinders are substantially vertical or at an angle of about 150 from the vertical reference, so that the vertical component of the force transmitted to the lever arms is greater than the horizontal component. Thus, each force-transmitting air cylinder is predominantly vertical during at least part of each cycle of operation. These positions of the force-transmitting air cylinders are defined by the frame 40 and the lever arms 42. The frame arms 46 and lever arms 42 are sized and angled to position the force-transmitting air cylinders 44 so that at least part of each force-transmitting device lies between a vertical plane 84 at the back 26 of the feed shoe 18 and a vertical plane 86 at the front 24 of the feed shoe 18 during at least part of each cycle of operation.

As shown in FIG. 8, the feed shoe 18 of the illustrated press assembly is horizontally movable across the surface of the platen 12 between a feed position shown in phantom and a press position shown in solid lines. In the feed position, the feed shoe overlies the bore 14 and die 16, and in the press position the feed shoe is horizontally spaced from the bore 14 and die 16 so that the punch 22 may enter the bore 14 without hitting the feed shoe. In the illustrated embodiment of the present invention, the hold down assembly or system 32 is horizontally movable with the feed shoe 18 between these two positions. Accordingly, the force-transmitting air cylinders 44 act against the frame 40 and lever arms 42 and apply a downward force on the feed shoe 18 as the feed shoe 18, frame 40, lever arms 42 and force-transmitting members 44 are moved between these horizontal positions.

The downward force on the feed shoe 18 is substantial with the hold down system 32 of the present invention. For example, using air-cylinders 44 providing a force of about 40 psi, the angle of the force-transmitting devices 44 and the angle of the segments 66 of the lever arms 42 would result in a downward force of about 112 pounds, plus or minus 20 pounds, exerted on the feed shoe 18 by the two air cylinders 44 during horizontal movement of the feed shoe 18.

As shown in FIG. 1, the press 10 includes a linear drive mechanism 34 connected to move the frame 40 horizontally over at least part of the platen 12, toward and away from the bore 14 in the platen 12 during each cycle of operation of the press. In the illustrated embodiment, the linear drive mechanism 34 comprises a ball screw feeder. The ball screw feeder includes an elongate threaded screw shown at 92 in FIG. 1. The elongate threaded screw 92 has a horizontal central longitudinal axis 94. One end 96 of the elongate threaded screw 92 is connected to an intermediate plate 98 that acts against the vertical member 48 of the frame 40; thus, the elongate screw 92 is connected to act against the vertical member 48 of the frame 40. The intermediate plate 98 may be fixed to the frame 40 through welding, nuts and bolts, or other convention means.

Commercially available ball screw devices may be used for the linear drive mechanism. One acceptable ball screw device is a Thomson Super Twin Pillow Block available from Thomson Saginaw Ball Screw Company, LLC, of Saginaw, Mich. (or Thomson Industries, Inc. of Port Washington, N.Y.), and through Motion Industries, Inc. of Birmingham, Ala. and other locations. It should be understood that this linear drive mechanism is identified for purposes of illustration only, and that the present invention is not limited to use of ball screw linear drive mechanisms or to this particular ball screw linear drive mechanism unless expressly set forth in the claims.

The press also includes a supplemental support 36. In the illustrated embodiment of the present invention, the supplemental support 36 comprises a pair of spaced elongate rods 100. Each rod 100 has a horizontal central longitudinal axis 102. The press also includes a pair of support bearings 104. Each support bearing 104 receives part of one of the elongate rods 100, and supports the rod 100 for movement of the rod 100 along its central longitudinal axis 102. The central longitudinal axes 102 of the rods 100 are parallel to each other and to the central longitudinal axis 94 of the screw of the ball screw device. In the illustrated embodiment, one end 106 of each elongate rod 100 is connected to the intermediate plate 98. Since the intermediate plate 98 is connected to the frame vertical member 48, the rods are connected to the frame 40 and move horizontally with the elongate screw 92 and with the frame 40.

The supplemental support 36 is connected, sized and positioned to provide lateral stability to the frame 40 and feed shoe 18 during horizontal movement of the frame 40 and feed shoe 18 and to relieve stress of the linear drive mechanism 34 from operation of the force-transmitting air-cylinders 44. The size and position of the supplemental support may be expected to vary with the size of feed shoe and the amount of force transmitted by the force-transmitting devices 44. In the illustrated embodiment, the feed shoe width between the sides 28, 30 may be on the order of 11 inches or so. The supplemental support should be placed so that the motion of the feed shoe is kept straight. In addition, the supplemental support should have adequate strength to guard the linear drive mechanism against damage from moments caused by the actions of the force-transmitting devices 44. When the feed shoe 18 is in the feed position, with the ball screw fully extended and spaced farthest from its support structure, the force-transmitting members would exert a large moment on the ball screw; provision of the supplemental support absorbs these moments so that the ball screw is not damaged. In the illustrated embodiment, the rods 100 are spaced apart a distance of 6–9 inches between the centerlines 102 of the rods 100, and the elongate screw 92 is centered between them. The distance between the rods 100 may vary depending on the size of the press. The illustrated support rods 100 have a diameter of 25 mm, a length of 18 inches and are made of class M 60 case rod. It should be understood that the spacing, size and material are identified for purposes of illustration only, and the invention is not limited to any spacing, size or material unless expressly set forth in the claims.

In the illustrated embodiment, the supplemental support 36 comprises commercially available rods from Thomson Industries, Inc. of Port Washington, N.Y., and available from Motion Industries, Inc. of Birmingham, Ala. and other locations. Suitable support bearings 104 may also be obtained from these suppliers. It should be understood that the invention is not limited to the use of a supplemental support, bearings or to any particular type of supplemental support or bearing unless expressly set forth in the claims.

Generally, in the illustrated embodiment, the support rods 100 should be connected to the intermediate plate 98, and the intermediate plate 98 should be secured to the vertical member 48 of the frame 40. With these members so secured, adequate stability should be provided to the feed shoe and the ball screw should be adequately protected from damage due to moments. It should be understood that it is not necessary to connect the rods 100 and screw 92 to the frame through an intermediate plate 98; the ball screw 92 and support rods 100 could be connected directly to the frame 40, such as at the vertical member 48.

To make and use the present invention, the frame 40 may be fabricated in a conventional manner, such as by welding the components together. The frame 40 may then be connected to the force-transmitting devices 44 and lever arms 42 through the connectors or pins 83 and 62. The force-transmitting devices 44 may then also be connected to the lever arms 42 through the pins 78. The connections between the lever arms 42 and the frame 40 and between the force-transmitting devices 44 and the lever arms 42 all allow the lever arms 42 to pivot relative to the frame and the force transmitting devices. The connections between the frame 40 and the force transmitting devices 44 also allow pivoting of the force-transmitting devices 44 relative to the frame 40. The feed shoe 18 is connected through the releasable connectors 71 to the lever arms 42; these connections allow the lever arms 42 to pivot relative to the feed shoe 18.

The feed shoe 18 is connected to the raw material supply path 20. After the feed shoe 18 has received raw material such as powder metal through the supply path 20, the linear drive mechanism 34 may be actuated. The elongate screw 92 pushes against the intermediate plate 98, and moves the intermediate plate 98 and frame 40 horizontally over the surface 13 of the platen 12. Horizontal movement of the frame 40 moves the lever arms 42 horizontally with the frame, and the lever arms 42 push the feed shoe 18 from the press position to the feed position. While the feed shoe 18 is so moving, the force-transmitting devices 44 apply a continuous downward force on the feed shoe 18 through the lever arms 42 and connectors 71, 78; thus, the force-transmitting devices 44 urge the feed shoe 18 against the platen 12. The force-transmitting devices 44 act against the frame 40 and lever arms 42 in applying this downward force. Since the pins 71 connecting the lever arms 42 to the feed shoe 18 are horizontally aligned with the centroid of the feed shoe 18, the downward force does not cause any part of the feed shoe to raise off of the surface 13 of the platen 12; instead, the moments created by the downward force on the connection to the feed shoe should be balanced.

As the feed shoe 18, frame 40, lever arms 42 and force-transmitting devices 44 move horizontally, the rods 100 of the supplemental support 36 and bearings 104 provide support to limit stress on the elongate screw 92 of the linear drive mechanism 34 from the downward force exerted by the force-transmitting devices 44. The rods 100 of the supplemental support 36 and bearings 104 also stabilize the frame 40 and feed shoe 18 against movement off of the desired linear path of travel. As shown in FIG. 8, the feed shoe 18, lever arms 42, frame 40, force-transmitting devices 44, and parts of the linear drive mechanism 34 and supplemental support 36 all move horizontally across the platen 12 as a unit between the feed and press positions during each cycle of operation. The force-transmitting devices 44 urge that feed shoe 18 against the platen 12 during at least part of this horizontal movement of the feed shoe 18, lever arms 42, frame 40 and force-transmitting devices 44, and preferably throughout the entire path of horizontal travel back and forth between the press and feed positions of the feed shoe.

When the feed shoe 18 reaches the feed position and overlies the bore 14 in the surface 13 of the platen 12, the raw material carried by the feed shoe is dropped into the cavity of the die 16. The linear drive mechanism 34 then retracts the frame 40 to pull the lever arms 42, force-transmitting devices 44 and feed shoe 18 back to the press position. Once the frame 40, lever arms 42, force-transmitting devices 44 and feed shoe 18 are retracted, the punch 22 moves down to compress the raw material in the die 16. When the raw material is adequately compressed, or when a preset time interval has passed, the punch 22 is raised. The platen 12 is then lowered as shown in FIG. 7 so that the compact may be ejected from the die 16.

As the platen 12 lowers, the feed shoe 18 travels vertically with the platen. As the feed shoe 18 moves vertically, the frame 40, linear drive mechanism 34, rods 100 of the supplemental support 36 and bearings 104 remain vertically fixed, and are fixed at constant vertical levels throughout each cycle of operation of the press. However, the lever arms 42 move as the platen and feed shoe move vertically: as shown in FIG. 7, the lever arms 42 pivot about the connection 62 to the frame 40 and about the connection 71 to the feed shoe 18. In addition, the piston rods 80 move by telescoping out of the cylinders 82, and the rods and cylinders may pivot about their connections 78 and 83.

After the compact is ejected from the die 16, the platen is raised to its original position, shown in phantom in FIG. 7. As the platen 12 is raised, the feed shoe 18 is also raised to the position shown in phantom in FIG. 7. As the feed shoe is raised, the lever arms 42 pivot about the connection 62 to the frame 40 and about the connection 71 to the feed shoe 18. The piston rods 80 are pushed back into the cylinders 82, and the air cylinders 44 transmit force to the lever arms 42 through the connectors 78 to thereby exert a downward force on the feed shoe 18 through the connectors 71; thus, the force-transmitting devices 44 urge the feed shoe 12 against the surface 13 of the platen 12. The press continues operating in these steps to produce one or more compacts in each cycle of operation.

The press 10 of the present invention is particularly useful in making powder metal compacts. The raw material supply path 20 may be connected to a supply of metal powder to be compacted. The green compact produced by the press may then be sintered and subjected to further processes as known in the art. However, it is expected that the hold-down system 32 of the present invention will have utility in making other products from other raw materials on presses.

Figure 9:
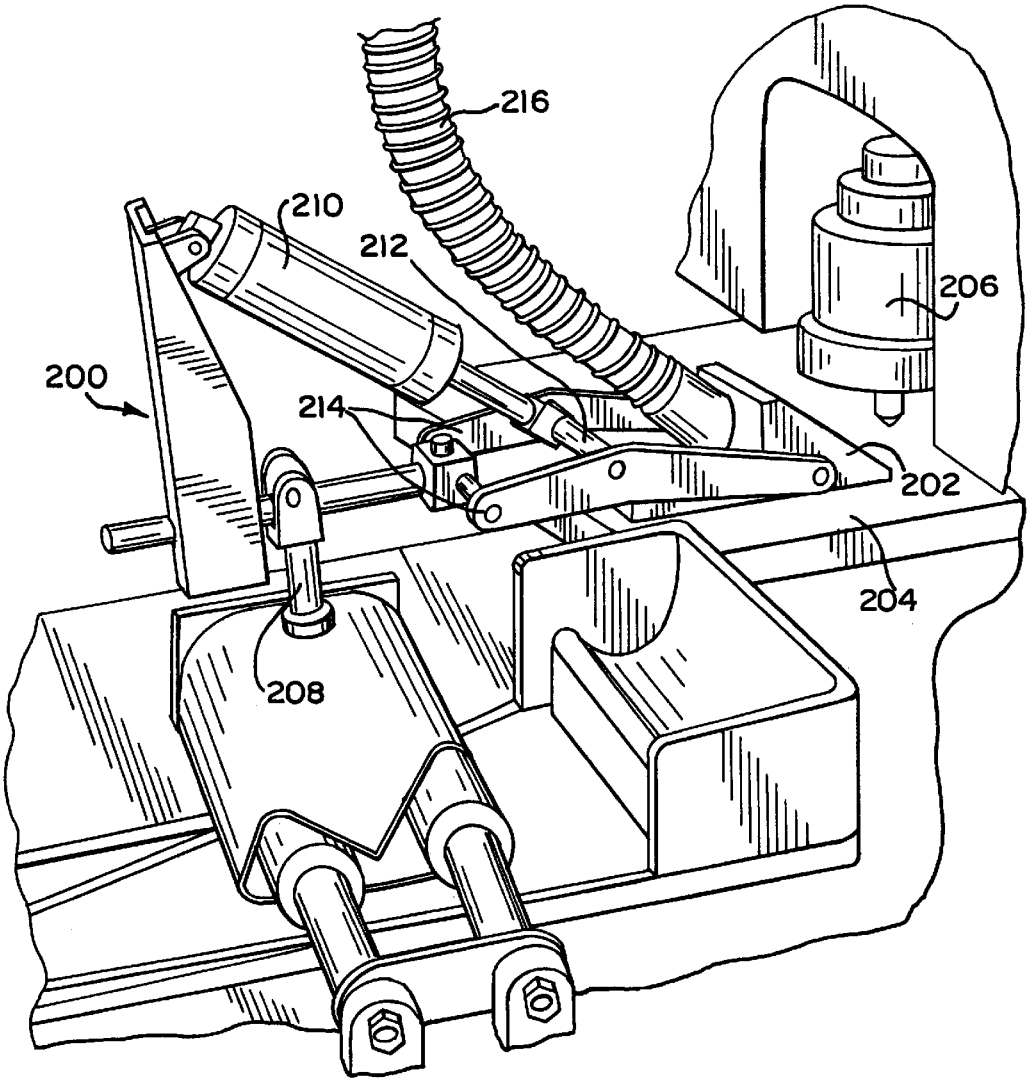
FIG. 9 PRIOR ART
FIG. 9 is a perspective view of a prior art press assembly.

Changing of the feed shoe 18 in the press of the present invention is simple and relatively quick. One need only release the pins 78 to free the feed shoe 18 from the hold-down system 32. A different feed shoe can then be placed on the platen between the lever arms 42, and the pins 78 inserted to connect the new feed shoe to the hold-down system 32. Compared to the prior art system of FIG. 9, the hold-down system of the present invention is more versatile: the hold-down system of the present invention is usable with larger feed shoes and with systems using a linear drive to move the feed shoe across the platen. The hold-down system of the present invention also provides a substantially greater downward vertical component of force on the feed shoe than the system of FIG. 9.

Compared to the prior art system of FIGS. 10–11, the hold-down system of the present invention does not experience the wear from continuous rubbing of the components. Moreover, the hold-down system of the present invention is substantially less expensive than the prior art rail system of FIGS. 10–11. Overall, the feed shoe of the present invention is held against the press platen in an efficient manner using less expensive components than the rails, bearings and springs of the prior art illustrated in FIGS. 10–11.

While only specific embodiments of the invention have been described and shown, it is apparent that various alternatives and modifications can be made thereto. Those skilled in the art will recognize that certain modifications can be made in these illustrative embodiments. It is, therefore, the intention in the appended claims to cover all such modifications and alternatives as may fall within the true scope of the invention.

I claim:

1. A press for compacting raw material into a compact during a cycle of operation comprising:

a vertically movable platen having a surface with a bore;

a die below the platen surface and aligned with the bore in the platen surface;

a feed shoe on the platen and movable with vertical movement of the platen, the feed shoe being movable horizontally across the platen surface from a press position spaced from the bore to a feed position overlying the bore to deliver raw material to the die;

a movable punch to compact raw material in the die;

a horizontally movable frame;

a lever arm connected to said frame and said feed shoe;

a force-transmitting device connected to act against said frame and said lever arm;

a linear drive mechanism; and a supplemental support connected, sized and positioned to relieve stress on said linear drive mechanism from operation of said force-transmitting device;

said linear drive mechanism being connected to move said frame horizontally over at least part of the platen toward and away from the bore in the platen surface;

said feed shoe, said frame, said lever arm, said force-transmitting device and at least part of said supplemental support moving horizontally with said frame during each cycle of operation, said force-transmitting device urging said feed shoe against said platen during at least part of the horizontal movement of said feed shoe, force-transmitting device, lever arm and frame;

said frame, said linear drive mechanism and said supplemental support being vertically fixed during each cycle of operation of said press; and said feed shoe and said platen moving vertically during each cycle of operation of said press.

2. The press of claim 1 wherein said supplemental support comprises a pair of spaced elongate rods, each rod having a horizontal central longitudinal axis, the press further comprising a pair of support bearings, each support bearing receiving a part of one of said rods, the central longitudinal axes of said rods being parallel to each other.

3. The press of claim 2 wherein said linear drive mechanism comprises a ball screw device including an elongate screw with a horizontal central longitudinal axis disposed between said pair of rods, said elonga rew central longitudinal axis being parallel to said central longitudinal axes of said rods.

4. The press of claim 3 wherein said rods are connected, sized and positioned to provide lateral stability to said frame during horizontal movement of said frame.

5. The press of claim 1 further comprising a releasable connector connecting each lever arm to said feed shoe.

6. The method of making powder metal compacts using the press of claim 1.

7. A press for compacting raw material into a compact during a cycle of operation comprising:

a vertically movable platen having a surface with a bore;

a die below the platen surface and aligned with the bore in the platen surface;

a feed shoe on the platen and movable with vertical movement of the platen, the feed shoe being movable horizontally across the platen surface from a press position spaced from the bore to a feed position overlying the bore to deliver raw material to the die, said feed shoe having a front and a back;

a movable punch to compact raw material in the die;

a horizontally movable frame;

a lever arm connected to said frame and to said feed shoe;

a force-transmitting device connected to act against said frame and said lever arm; and a linear drive mechanism connected to move the frame horizontally over at least part of the platen toward and away from the bore in the platen surface during each cycle of operation, said feed shoe, said lever arm and said force-transmitting device moving horizontally with said frame during each cycle of operation, said force-transmitting device urging said feed shoe against said platen during at least part of the horizontal movement of said frame, feed shoe, lever arm and force-transmitting device;

said frame and said linear drive mechanism being vertically fixed during each cycle of operation of said press;

said feed shoe and said platen moving vertically during each cycle of operation;

wherein at least part of said force-transmitting device lies between a vertical plane at the back of the feed shoe and a vertical plane at the front of the feed shoe during at least part of each cycle of operation.

8. The press of claim 7 wherein said frame includes a pair of spaced parallel frame arms extending from a low point to a high point between the low point and the front of said feed shoe, each of said frame arms being angled so that said high point is horizontally spaced from said low point, said force-transmitting device being connected to one of said high points of said frame arms.

9. The press of claim 8 wherein each arm defines an angle of about 30° with a vertical reference.

10. The press of claim 8 wherein said linear drive mechanism comprises a ball screw device including an elongate screw having a horizontal central longitudinal axis and one end connected to said frame, said press further comprising a supplemental support including a pair of spaced elongate rods, one rod on each side of said elongate screw, each rod having a horizontal central longitudinal axis and one end connected to said frame, said rods and said elongate screw extending away from said frame and said platen, the press further including a bearing supporting a part of one rod for movement along the central longitudinal axis of the rod and a bearing supporting part of the other rod for movement along the central longitudinal axis of the rod.

11. The press of claim 7 wherein said force-transmitting device comprises an air cylinder.

12. The press of claim 7 further comprising a releasable connector connecting said lever arm to said feed shoe.

13. The method of making powder metal compacts using the press of claim 7.

14. A press for compacting raw material into a compact during a cycle of operation comprising:

a vertically movable platen having a surface with a bore;

a die below the platen surface and aligned with the bore in the platen surface;

a feed shoe on the platen surface and movable with vertical movement of the platen, the feed shoe being movable horizontally across the platen surface from a press position spaced from the bore to a feed position overlying the bore to deliver raw material to the die;

a movable punch to compact raw material in the die;

a horizontally movable frame;

a lever arm connected to said frame and said feed shoe;

a force-transmitting device connected to act against said frame and said lever arm; and a linear drive mechanism connected to move the frame horizontally over at least part of the platen toward and away from the bore in the platen surface during each cycle of operation, said lever arm, said feed shoe, lever arm and said force-transmitting device moving horizontally with said frame during each cycle of operation, said force-transmitting device urging said feed shoe against said platen during at least part of the horizontal movement of said frame, feed shoe, lever arm and force-transmitting device;

said frame and said linear drive mechanism being vertically fixed during each cycle of operation of said press;

said feed shoe and said platen moving vertically during each cycle of operation;

said force-transmitting device being aligned to be predominantly vertical during at least part of each cycle of operation.

15. The press of claim 14 wherein said frame includes a pair of spaced parallel frame arms extending from a low point to a high point between the low point and the front end of said feed shoe, each of said framers being angled so that said high point is horizontally spaced from said low point, said force-transmitting device being connected to one of said high points of said frame arms.

16. The press of claim 15 wherein each arm defines an angle of about 30° with a vertical reference.

17. The press of claim 15 wherein said linear drive mechanism comprises a ball screw device including an elongate screw having a horizontal central longitudinal axis and one end connected to said frame, said press further comprising a pair of spaced elongate supplemental support rods, one rod on each side of said elongate screw, each rod having a horizontal central longitudinal axis and one end connected to said frame, said rods and said elongate screw extending away from said frame and said platen, the press further including a bearing supporting a part of one rod for movement along the central longitudinal axis of the rod and a bearing supporting part of the other rod form movement along the central longitudinal axis of the rod.

18. The press of claim 14 wherein said force-transmitting device comprises an air cylinder.

19. The press of claim 14 further comprising a releasable connector connecting each lever arm to said feed shoe.

20. The method of making powder metal compacts using the press of claim 14.

21. A press for compacting raw material into a compact during a cycle of operation comprising:

a vertically movable platen having a surface with a bore;

a die below the platen surface and aligned with the bore in the platen surface;

a feed shoe on the platen and movable with vertical movement of the platen, the feed shoe being movable horizontally across the platen surface from a press position spaced from the bore to a feed position overlying the bore to deliver raw material to the die;

a movable punch to compact raw material in the die;

a horizontally movable frame;

a linear drive mechanism connected to move the frame horizontally over at least part of the platen toward and away from the bore in the platen surface;

a lever arm connected to said frame and said feed shoe;

a force-transmitting device connected to act against said frame and said lever arm;

said frame, said lever arm, said feed shoe and said force-transmitting device moving horizontally during each cycle of operation, said force-transmitting device urging said feed shoe against said platen during at least part of the horizontal movement of said frame, lever arm, feed shoe and force-transmitting device;

the press further including a supplemental support connected, sized and positioned to stabilize said frame during horizontal movement of said frame, lever arm, feed shoe and force-transmitting device;

said frame, said linear drive mechanism and said spaced supplemental support being vertically fixed during each cycle of operation of said press; and said feed shoe and platen moving vertically during each cycle of operation of the press.

22. The press of claim 21 wherein said frame includes a pair of spaced parallel frame arms extending from a low point to a high point between the low point and the front end of said feed shoe, each of said frame arms being angled so that said high point is horizontally spaced from said low point, said force-transmitting device being connected to one of said high points of said frame arms.

23. The press of claim 22 wherein each arm defines an angle of about 30° with a vertical reference.

24. The press of claim 22 wherein said frame further includes a vertical member and said linear drive mechanism comprises a ball screw device including an elongate screw having a horizontal central longitudinal axis and one end connected to said vertical member of said frame, said press further comprising a supplemental support rod on each side of said elongate screw, each rod having a horizontal central longitudinal axis and one end connected to said frame, said rods and said elongate screw extending rearward away from said vertical member and said platen, the press further including a bearing supporting a part of one rod for movement along the central longitudinal axis of the rod and a bearing supporting part of the other rod for movement along the central longitudinal axis of the rod.

25. The press of claim 21 wherein said force-transmitting device comprises an air cylinder.

26. The press of claim 21 further comprising a releasable connector connecting each lever arm to said feed shoe.

27. The method of making powder metal compacts using the press of claim 21.

* * * * *